US010472919B2

(12) United States Patent
Angman et al.

(10) Patent No.: US 10,472,919 B2
(45) Date of Patent: Nov. 12, 2019

(54) TENSION RELEASE PACKER FOR A BOTTOMHOLE ASSEMBLY

(71) Applicants: Per Angman, Calgary (CA); Mark Andreychuk, Calgary (CA)

(72) Inventors: Per Angman, Calgary (CA); Mark Andreychuk, Calgary (CA)

(73) Assignee: KOBOLD CORPORATION, Calgary (CA)

( * ) Notice: Subject to any disclaimer, the term of this patent is extended or adjusted under 35 U.S.C. 154(b) by 594 days.

(21) Appl. No.: 15/013,983

(22) Filed: Feb. 2, 2016

(65) Prior Publication Data

US 2016/0222755 A1 Aug. 4, 2016

Related U.S. Application Data

(60) Provisional application No. 62/110,994, filed on Feb. 2, 2015.

(51) Int. Cl.
*E21B 33/128* (2006.01)

(52) U.S. Cl.
CPC ..... *E21B 33/128* (2013.01)

(58) Field of Classification Search
CPC ..... E21B 33/128
See application file for complete search history.

(56) References Cited

U.S. PATENT DOCUMENTS 1,804,818 A * 5/1931 Spang ..... E21B 33/128 166/118
2,699,214 A * 1/1955 Sweet ..... E21B 33/128 24/535
3,391,742 A * 7/1968 Davis ..... E21B 33/1292 166/139
3,578,078 A * 5/1971 Shillander ..... E21B 49/087 166/152
3,991,826 A * 11/1976 Baugh ..... E21B 23/06 166/120
4,375,240 A * 3/1983 Baugh ..... E21B 33/1295 166/120
5,311,938 A * 5/1994 Hendrickson ..... E21B 33/1216 166/134
5,433,269 A * 7/1995 Hendrickson ..... E21B 33/1208 166/134
7,278,486 B2 * 10/2007 Alba ..... E21B 33/128 166/297
8,109,340 B2 * 2/2012 Doane ..... E21B 33/128 166/138

* cited by examiner

*Primary Examiner* — Matthew R Buck

(74) *Attorney, Agent, or Firm* — Parlee McLaws LLP (CGY); Sean Goodwin

(57) ABSTRACT

A resettable elastomeric packer element of a packer, compressed for sealing in a wellbore, is released from sealing engagement in the wellbore by applying tension to an end of the packer element. The elastomeric packer element stretches and releases from the wellbore forming an annular passageway between the packer element and the wellbore. In the absence of a pressure equalization valve or flow passages through the packer, the annular passageway equalizes pressure differentials across the packer element allowing a tool, in which the packer is incorporated, to be moved in the wellbore with little or no damage to the packer element and further, allows debris to flow from above the packer to below the packer.

32 Claims, 13 Drawing Sheets

38
30,36
40
16
18
set
20
D
28
14
12

38
30,36
40
16
18
20
D
28
14
12

TENSION RELEASE PACKER FOR A BOTTOMHOLE ASSEMBLY

CROSS-REFERENCE TO RELATED APPLICATIONS

This application claims the benefit of U.S. provisional application 62/110,994, filed Feb. 2, 2015, the entirety of which is incorporated herein by reference.

FIELD

Embodiments disclosed herein relate to apparatus and methods for actuating and sealing a packer in a wellbore, more particularly to an elastomeric packer actuated at least in part through application of tension to the elastomer, and methods of use in completion operations.

BACKGROUND

It is known to place one or more packers in a wellbore to separate zones above the packer from zones below. Resettable packers are known that can be set for a single operation, then be released to move in the wellbore for removal of the packer and associated tools therefrom, or moved within the wellbore to be set at another location for a subsequent operation.

It is also well known to complete or line wellbores with liners or casing and the like and, thereafter, to use resettable packers to separate the wellbore uphole and downhole of the packer, such as to direct treatment fluids, for example fracturing fluids, through flowpaths created through the casing to reach the formation therebeyond.

Conventional methodologies for creating flow paths include perforating the casing using apparatus such as a perforating gun which typically utilizes an explosive charge to create localized openings through the casing and or abrasive jetting for eroding openings therethrough. Alternatively, the casing can include pre-machined ports, located at intervals therealong. The ports are typically sealed during insertion of the casing into the wellbore, such as by a dissolvable plug, a burst port assembly, a sleeve or the like. Thereafter, the ports are typically selectively opened by removing the sealing means to permit fluids, such as fracturing fluids, to reach the formation. Typically, when sleeves are used to seal the ports, the sleeves are releasably retained over the port and can be actuated to slide within the casing to open the port. Many different types of sleeves and apparatus to actuate the sleeves are known in the industry.

Treatment fluids are directed at high pressure into the formation through the open ports. At least one sealing means, such as a resettable packer, is employed to isolate the balance of the wellbore below the treatment port from the treatment fluids. In U.S. Pat. No. 6,394,184 (Tolman) to Exxon, a resettable packer, as part of a bottom hole assembly (BHA), is set below perforations. A circulation port sub, above the packer, provides a flowpath to wash debris from above the resettable packer to aid in releasing the packer or to inject treatment fluid to the formation.

Further, in some known methodologies, using tubular strings having sleeves for initially blocking treatment ports, the BHA includes a resettable packer that is also used to both shift the sleeve and seal below the treatment ports including: to engage and seal to a sleeve for shifting the sleeve open such as taught in U.S. Pat. No. 6,024,173 (Patel) to Schlumberger, or in combination with a locator, key or anchor to engage seal and shift the sleeve U.S. Pat. No. 1,828,099 (Crowell) and Canadian Patents 2,738,907 and 2,693,676, both to NCS Oilfield Services Canada Inc.

In the BHAs having resettable packers, it is known to provide equalization valves in the conveyance string or in the BHA for releasing a pressure differential across the packer to aid in its release and to permit movement of the BHA within the wellbore. Equalization valves are generally situated within the BHA to allow fluid to bypass the packer through the structure of the BHA itself. Both U.S. Pat. No. 6,394,184 (see Col 13, 14) and CA 2,693,676 disclose equalization valves wherein equalization fluid flow is directed through the BHA.

Further, the typical resettable packer is actuable in combination with a mechanical indexing mechanism, such as a J-slot apparatus, using uphole and downhole axial manipulation of the conveyance string to shift the resettable packer between an actuated, sealing position and reset positions. U.S. Pat. No. 6,394,184 (Col 15) and CA 2,693,676 disclose J-slots for actuating and de-actuating resettable packers, as well as the use of equalization valves. A packer element is located on a mandrel that is telescopically fit into a housing. The telescopic action alternately compresses and releases the packer element therebetween. The mandrel is fit with a J-slot component that operatively engages a corresponding second component within the housing. To equalize pressure above and below the packer, fluids must pass through the mandrel and housing to bypass the packer element.

When actuated, the packer element is axially compressed to radially expand into sealing contact with a surrounding tubular. Typically, actuation of a packer is contemporaneous with setting of an anchor to the tubular, such as through a tubular cone driving slips radially outwardly into engagement with casing. When axial compression on the packer element is released, the expectation is that the packer element will retract radially and release from the tubular. Similarly, the anchor's cone is released from the slips, freeing the housing for movement within the tubular. The nature of known J-slots mechanisms requires axial movement to shift the indexing status of the J-slot, typically involving some axial force on the packer element whilst still actuated and engaged with the tubular, potentially damaging the packer element.

Efforts are being made to minimize packer element damage, including washing debris from about the uphole end of the packer and equalization of pressure differential across the packer before de-actuation, however packer failure is still a reality. Thus there is interest in apparatus and methods to further address this issue.

SUMMARY

Embodiments taught herein apply tension to a compressible, annular sealing element of a packer to release the packer from compressed sealing engagement with a casing, liner or wellbore. The annular sealing element, typically an elastomeric element, stretches and thins, releasing the element from the casing, liner or wellbore. When the packer element releases, a fluid passageway is formed in the annulus between the packer and the casing, liner or wellbore, allowing pressure to equalize across the packer elements and further providing a passageway for the debris to flow from above the packer to below the packer. Once pressure has been equalized, the packer element and bottomhole assembly, in which it is generally incorporated, is free to be moved axially within the wellbore.

The packer element is compressed and pulled into tension using a mandrel which is telescopically mounted within a housing and axially moveable therein. The packer element is operatively connected to the mandrel, such as through a ring secured to a pull end of the element. A compression ring, supported by the housing is positioned at an opposing trailing end of the element, the element being compressed between the ring and the compression ring, as the mandrel is moved axially toward the housing. Tension applied to the ring and pull end of the element acts to pull the element into tension, the element thinning and retracting from the casing, liner or wellbore for releasing therefrom.

In a broad aspect, a method for completing a wellbore comprises: running a completion tool, having a releasable packer therein, into the wellbore, the releasable packer having an elastomeric, annular sealing element; and anchoring means for anchoring the sealing element in the wellbore. The sealing element is located below a zone of interest in the wellbore. The elastomeric sealing element is compressed into sealing engagement with the wellbore, actuating the anchoring means. The zone of interest above the elastomeric sealing element is treated and thereafter; the packer is released from sealing engagement with the wellbore by applying axial tension to the elastomeric sealing element for forming an annular passageway between the elastomeric sealing element and the wellbore to equalize pressure thereabove with pressure therebelow.

In another broad aspect, a method of equalizing pressure above and below a compressible, annular sealing element of a packer set within a wellbore for sealing therebelow, comprises applying axial tension to a pull end of the annular sealing element for forming an annular passageway between the annular sealing element and the wellbore, releasing the annular sealing element from sealing therein, wherein pressure above and below the elastomeric sealing element is equalized through the annular passageway.

Advantageously, once the fluid passageway has been formed, debris above the annular sealing element can flow therein to below the element.

In yet another broad aspect, a method for protecting a compressible, annular sealing element of a packer in a tool, set within a wellbore, prior to moving the tool within the wellbore, comprises: applying axial tension to a pull end of the annular sealing element for forming an annular passageway between the annular sealing element and the wellbore for equalizing pressure above and below the annular sealing element. Thereafter, the tool can be moved in the wellbore.

In a broad apparatus aspect, a pressure equalization tool for use in a wellbore comprises a tubular housing having a bore therethrough; and a mandrel fit to the housing's bore and being telescopically and axially moveable therein. An elastomeric, annular packer element is fit concentrically about the mandrel and connected at a pull end thereto. An anchor anchors the housing in the wellbore. When the mandrel and annular packer element are moved axially toward the housing, the anchor is set and the annular packer element is compressed therebetween into sealing engagement with the wellbore for sealing an annulus between the mandrel and the wellbore. When the mandrel and annular packer element are pulled axially away from the housing, the annular packer element is pulled axially into tension and released from sealing engagement with the wellbore, forming a fluid passageway in the annulus for fluid communication past the annular packer element for equalizing pressure thereacross.

Use of a tension release packer, according to embodiments taught herein, may eliminate the need for a conventional pressure equalization valve. Further, embodiments may minimize or eliminate the need for flow passages through the BHA below the packer for flow of fluid and debris, thereby providing significant cross-sectional area of the BHA to accommodate electronics and other apparatus, enabling significant improvements in tool design.

DETAILED DESCRIPTION

Figure 1:
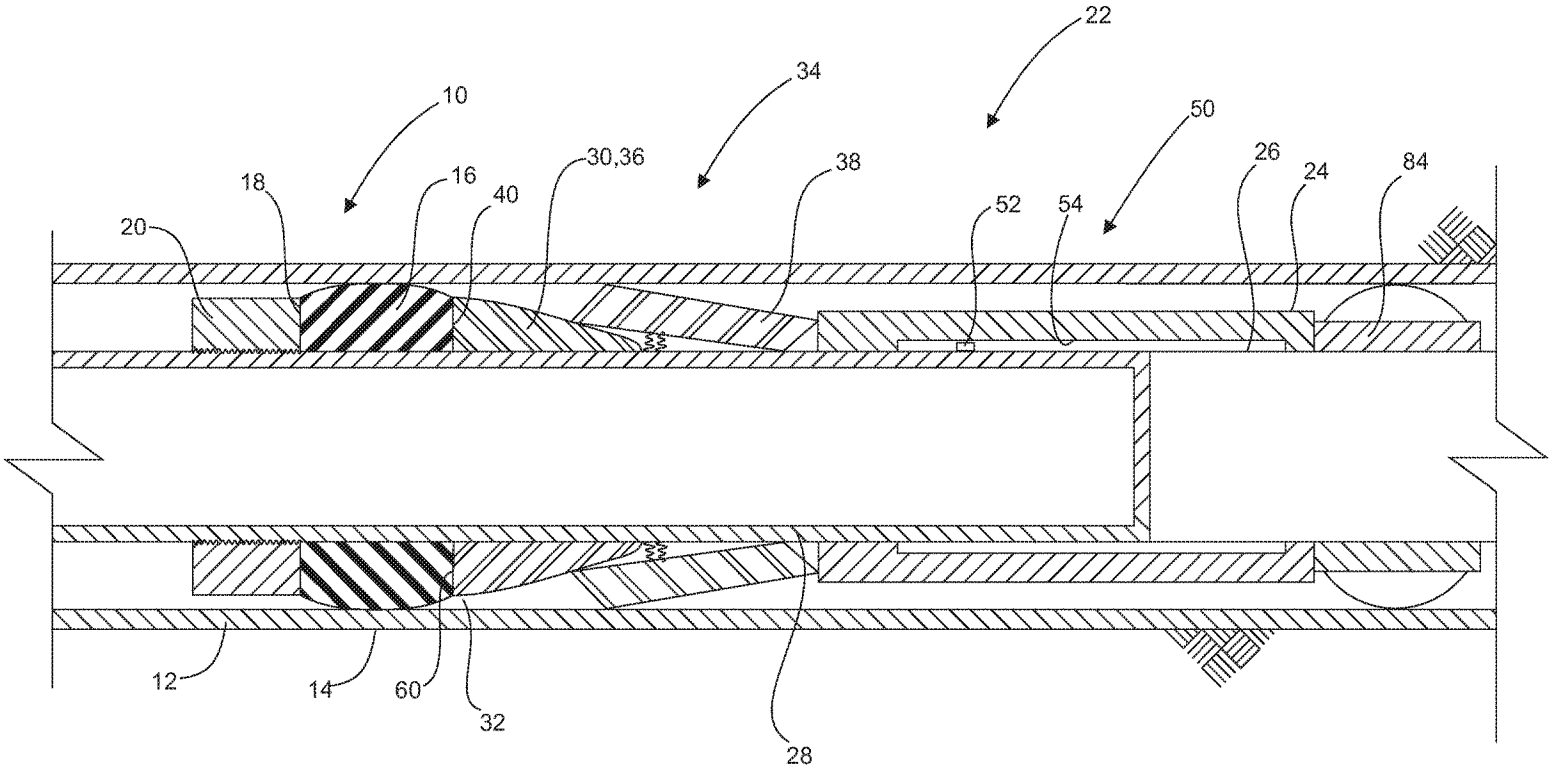
FIG. 1 is a partial cross-sectional view of a bottomhole assembly incorporating an embodiment of a tension release packer as described herein.

Herein, as shown in FIG. 1, a resettable packer 10 is configured to set and be released from a surrounding tubular 12, such as casing or a liner, or from the wellbore 14 in the case of an openhole completion. The resettable packer 10 is comprises an annular sealing element 16 that can be pulled in tension during commencement of a de-actuation operation to cause the annular sealing element 16 to retract radially and release from the surrounding tubular 12, 14. The tension release of the annular sealing element 16 from the tubular 12 avoids a dragging action between the annular sealing element 16 and the tubular 12 and swabbing therewith, thereby avoiding damage to the annular sealing element 16. Further, embodiments permit elimination of a pressure equalization valve in the packer, or downhole tool in which the packer is incorporated, as pressure is relieved in an annular passageway between the retracted annular sealing element 16 and the tubular 12. Embodiments may also permit elimination of debris relief passages through the downhole tool.

In embodiments, the annular sealing element 16 is a tubular elastomeric sealing element, having opposing ends. A pull end 18 is bonded or otherwise coupled or secured to a ring 20. The ring 20 acts, during compression of the annular sealing element 16, to aid in axially energizing the element 16 to expand radially outwards into sealing engagement with the casing 12. The ring 20 also acts to apply tension to the pull end 18 of the annular sealing element 16 for axially de-compressing the element 16, releasing the annular sealing element 16 from sealing engagement with the casing 12.

While rings are known in the prior art for use at the leading or uphole edge of packer elements to minimize flaring of the leading edge, intended to minimize swabbing and packer damage as a result of scraping on the inside of the tubular when the packer is pulled out of the wellbore, it is not known to pull such rings and an attached packer element into tension for reducing the diameter thereof. Generally, mechanisms such as pressure relief valves, also known as pressure equalization valves, are used to equalize a pressure differential across the packer element to first release the packer element from sealing engagement w the casing, the packer element thereafter retracting prior to moving a BHA 22 within the wellbore.

In the context of a resettable packer 10 for downhole operations within a wellbore tubular 12, such as casing, an embodiment of the BHA 22 comprises a pair of telescoping members which, among other operations, actuate and de-actuate the packer 10. The BHA 22 comprises a first member or tubular housing 24 having a bore 26 fit with a second member or mandrel 28, telescopically and axially movable within the housing 24. The housing 24 is sized for axial movement within the casing 12. The mandrel 28 is sized to fit movably and axially within the housing's bore 26. In embodiments, the housing 24 acts to support a compression ring 30. The mandrel 28 is fit with the ring 20, operatively connected thereabout for axial movement with the mandrel 28 and the annular sealing element 16. A sealing annulus 32 is formed between the mandrel 28 and the casing 12. As stated above, the ring 20 acts like a second compression ring during energizing of the annular sealing element 16.

The annular sealing element 16, being cylindrical, is located concentrically about the mandrel 28 in the sealing annulus 32 and is positioned axially between the ring 20 and the compression ring 30. The annular sealing element 16 is sized to fit movably and axially within the casing 12 when in an at-rest, uncompressed state. A telescoping action of the mandrel 28, within the housing 24, for axially moving the mandrel 28 toward the housing 24, also brings the ring 20 and the compression ring 30 together. The compression ring 30, if not secured to the housing 24, is supported against downhole movement at the housing 24. Thus, the ring 20, acting like a second compression ring, compresses the annular sealing element 16 axially therebetween. The reduced axial length causes the annular sealing element 16 to expand radially, filling the sealing annulus 32 and sealably engaging the casing 12.

The uphole and downhole orientation of the BHA's mandrel 28 and housing 24 is not critical for operation and compression actuation of the annular sealing element 16. A typical arrangement however is for the mandrel 28 to be uphole and the housing 24 downhole.

Embodiments of the packer 10 and the operation thereof are further described in the context of an uphole mandrel 28 and a downhole housing 24, in a cased wellbore.

Thus, as shown in FIGS. 1 and 2A through 2G, in a basic embodiment, a downhole axial movement of the uphole mandrel 28 moves the ring 20 axially downhole to act as a second compression ring, forcing the uphole pull end 18 of the annular sealing element 16 downhole. Without any obstacles to movement, the annular sealing element 16 is driven downhole towards the compression ring 30. The mandrel 28 telescopes within the housing 24. Drag between the housing 24 and the casing 12, or an anchor 34, such as a cone 36 and slip 38 arrangement, operatively connected to the housing 24 or BHA 22 therebelow, restricts axial movement of the housing 24 and permits relative axial movement between the mandrel 28 and housing 24.

Figures 2A, 2B:
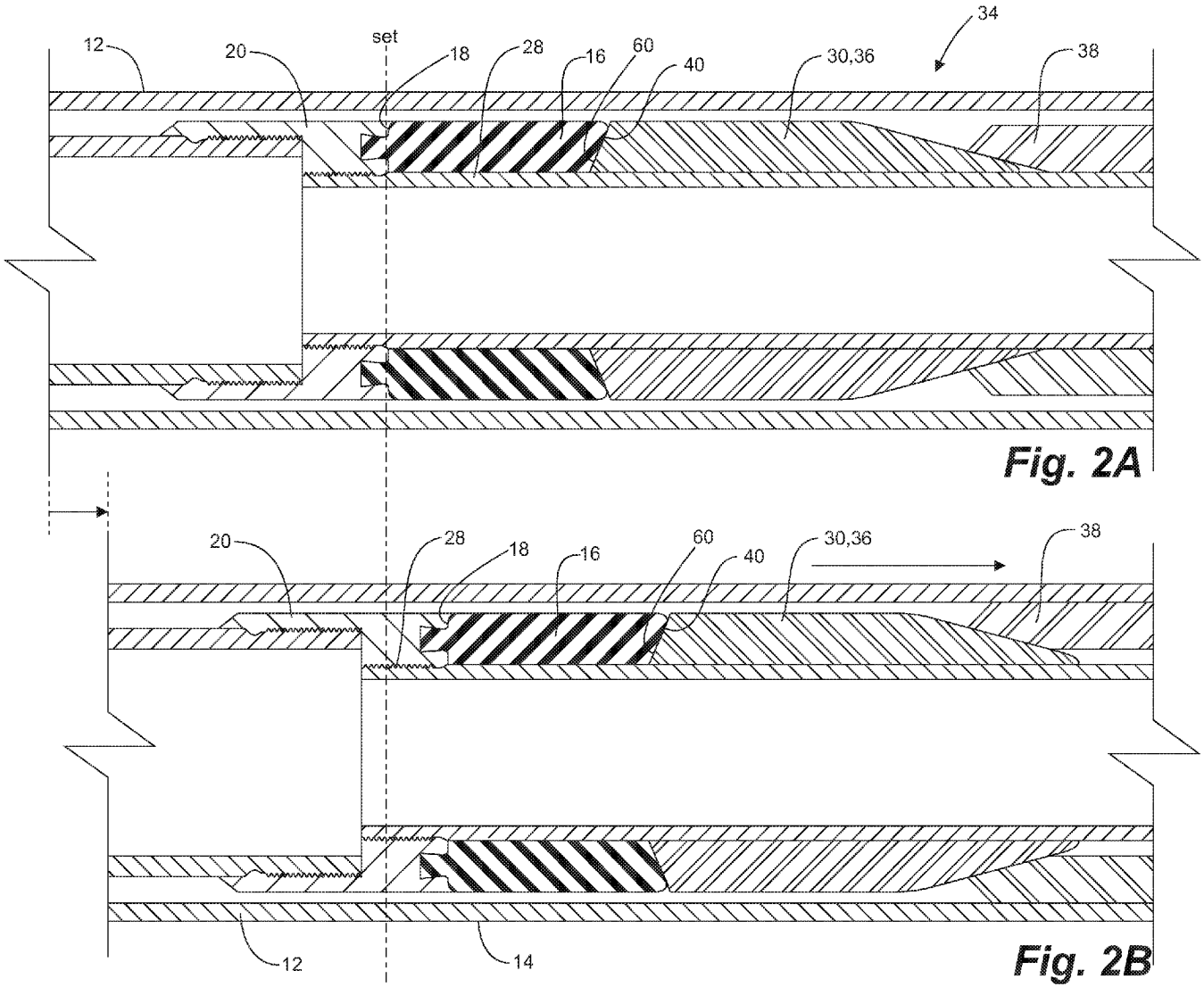
FIG. 2A is a cross-sectional view of an embodiment of the tension release packer of FIG. 1 a packer element being shown in an unset position.
FIG. 2B is a cross-sectional view according to FIG. 2A, a mandrel and packer element having been moved toward a housing in a wellbore, the packer element engaging a compression ring supported by the housing, the compression ring being a tubular cone of a cone and slip anchor.
Figure 2C:
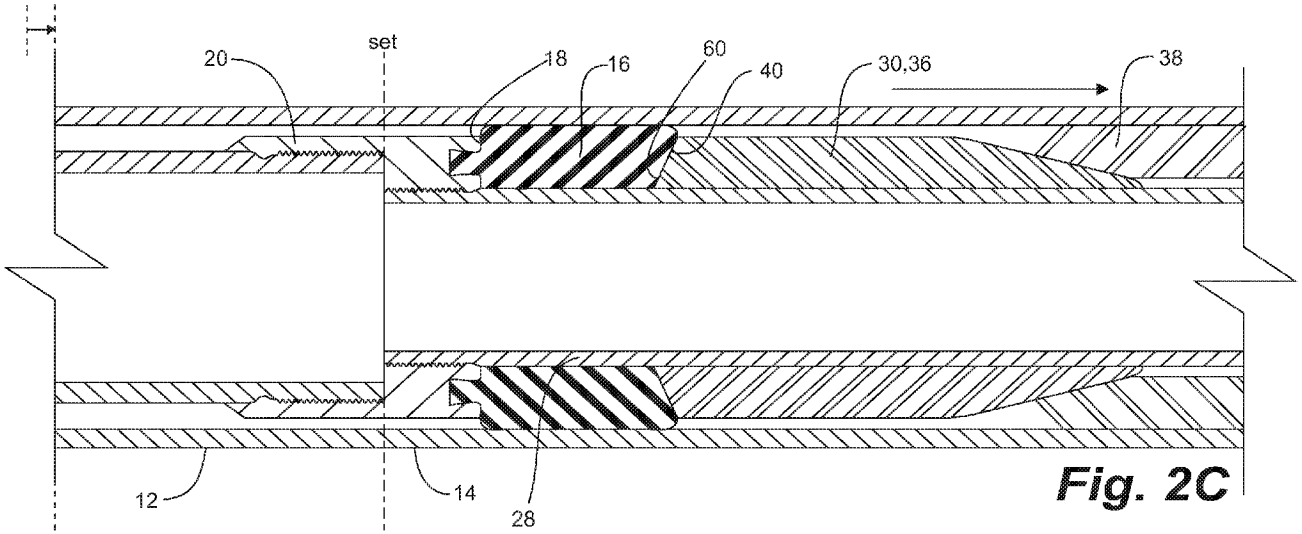
FIG. 2C is a cross-sectional view according to FIG. 2B, the mandrel and packer element having been moved downhole sufficient to compress the packer element, between a ring secured to a pull end of the packer and the compression ring at the housing, expanding the packer element to seal against the wellbore or a casing in the wellbore.

A trailing or downhole end 40 of the annular sealing element 16 engages the downhole compression ring 30, sandwiching the annular sealing element 16 therebetween. (FIG. 2B) As the axial length of the annular sealing element 16 is reduced, the annular sealing element 16 expands radially (FIG. 2C).

Figure 2D:
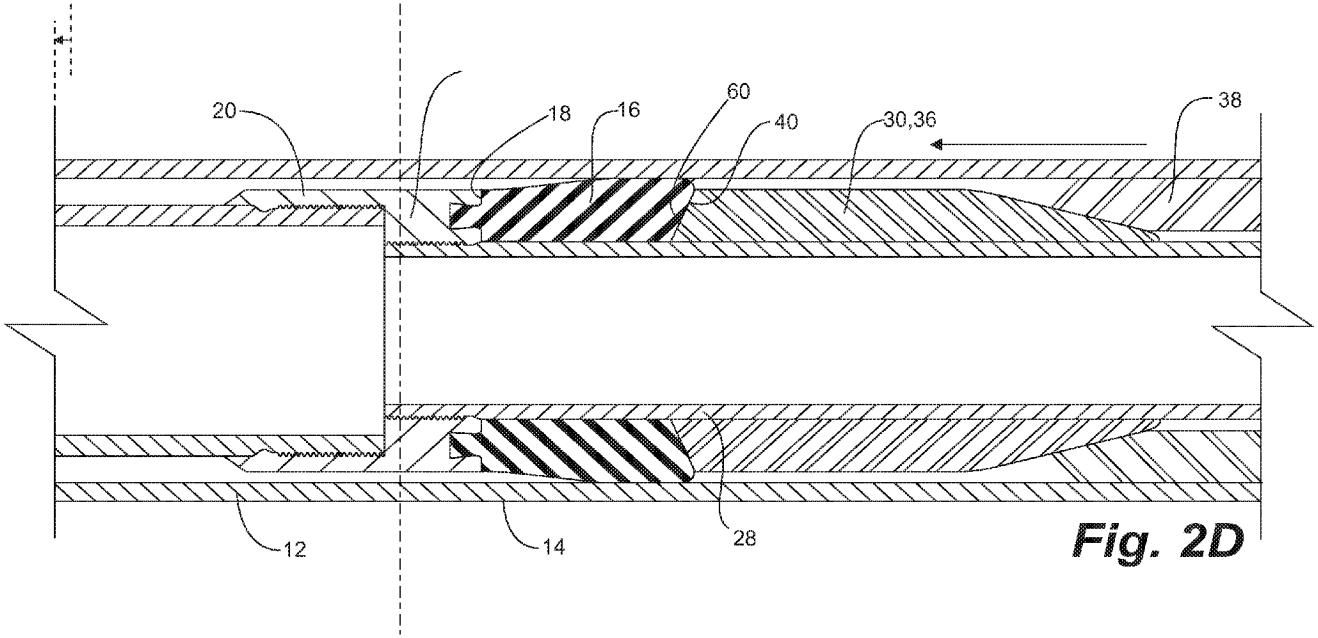
FIG. 2D is a cross-sectional view according to FIG. 2C, wherein the mandrel is moved away from the housing pulling the ring and the pull end of the packer element secured thereto for applying tension to the packer element, the pull end of the packer, being the uphole end in this embodiment, thinning and releasing from the casing.

To release the annular sealing element 16, the uphole member, being the mandrel 28 in this embodiment, is moved axially uphole (FIG. 2D). This is in direct contradistinction to prior art operations where a ring at the uphole end of the packer element is not intended for pulling the elements and is therefore not operatively connected to the mandrel to provide tension to the packer element. In the prior art therefore when the mandrel and ring are axially upward relative to the uphole end of the packer element, the packer element may be left radially energized against the casing as a result of pressure in the annulus above the packer element acting thereat.

Having reference again to FIG. 1, in the prior art and in embodiments taught herein, a J-slot mechanism 50 can be provided between the mandrel 28 and the housing 24. For example, a downhole portion of the mandrel 28 can be fit with radial followers or pegs 52 that track in a j-slot profile 54 fit in the housing's bore 26. The J-slot profile 54 can include three modes, for retaining the anchor's slips 38 in: a run-in or ready mode, a set mode, and a pull-up or release mode, as is understood in the art. Using many of the known prior art J-slot mechanisms, there is typically a requirement to pull upon the mandrel to shift from the set to the release mode which, absent the tension release packer 10 disclosed herein, would result in a damaging dragging of an energized packer element, and swabbing therewith, before the packer element finally releases.

Figures 2E, 2F:
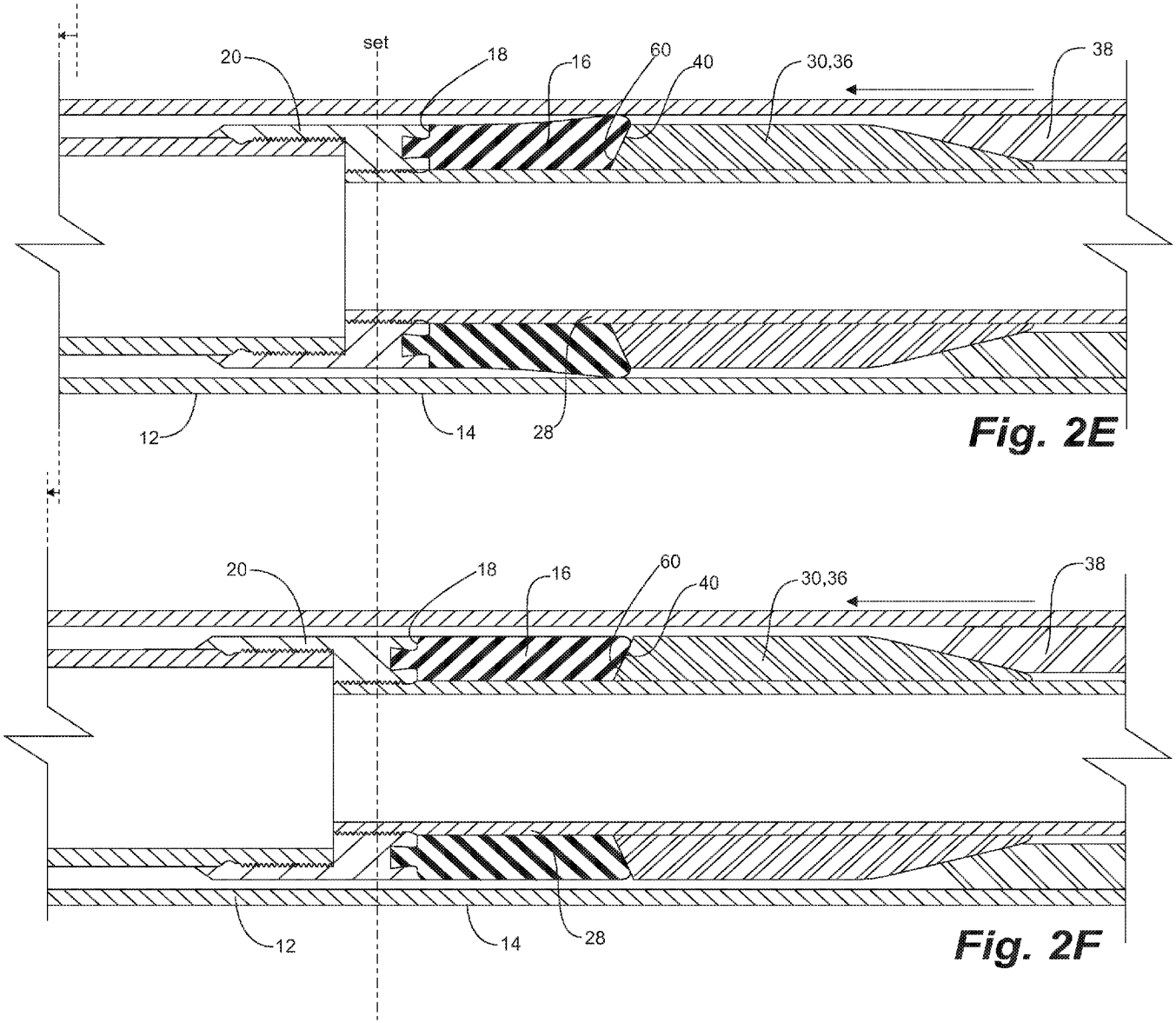
FIG. 2E is a cross-sectional view according to FIG. 2D, wherein mandrel, ring and the packer element are pulled further uphole in tension, more of a body of the packer element, extending axially from the pull end, thinning and releasing from the casing.
FIG. 2F is a cross-sectional view according to FIG. 2E, wherein the packer element, in tension, is fully released from the casing forming an annular fluid passageway thereby.
Figure 2G:
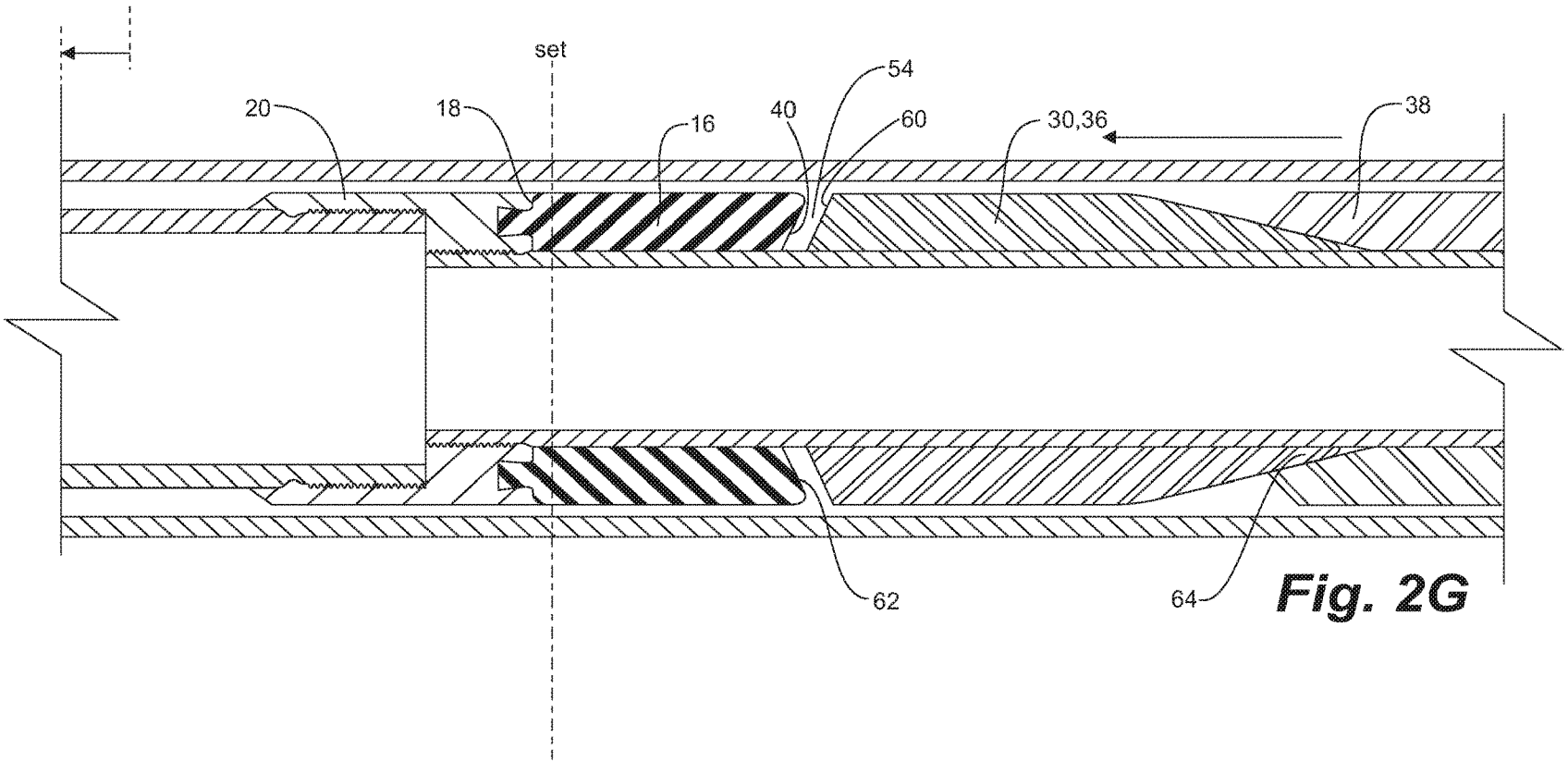
FIG. 2G is a cross-sectional view according to FIG. 2E, the packer being returned to the unset position of FIG. 1A, a gap forming between the packer element and the tubular cone.
Figures 3A, 3B:
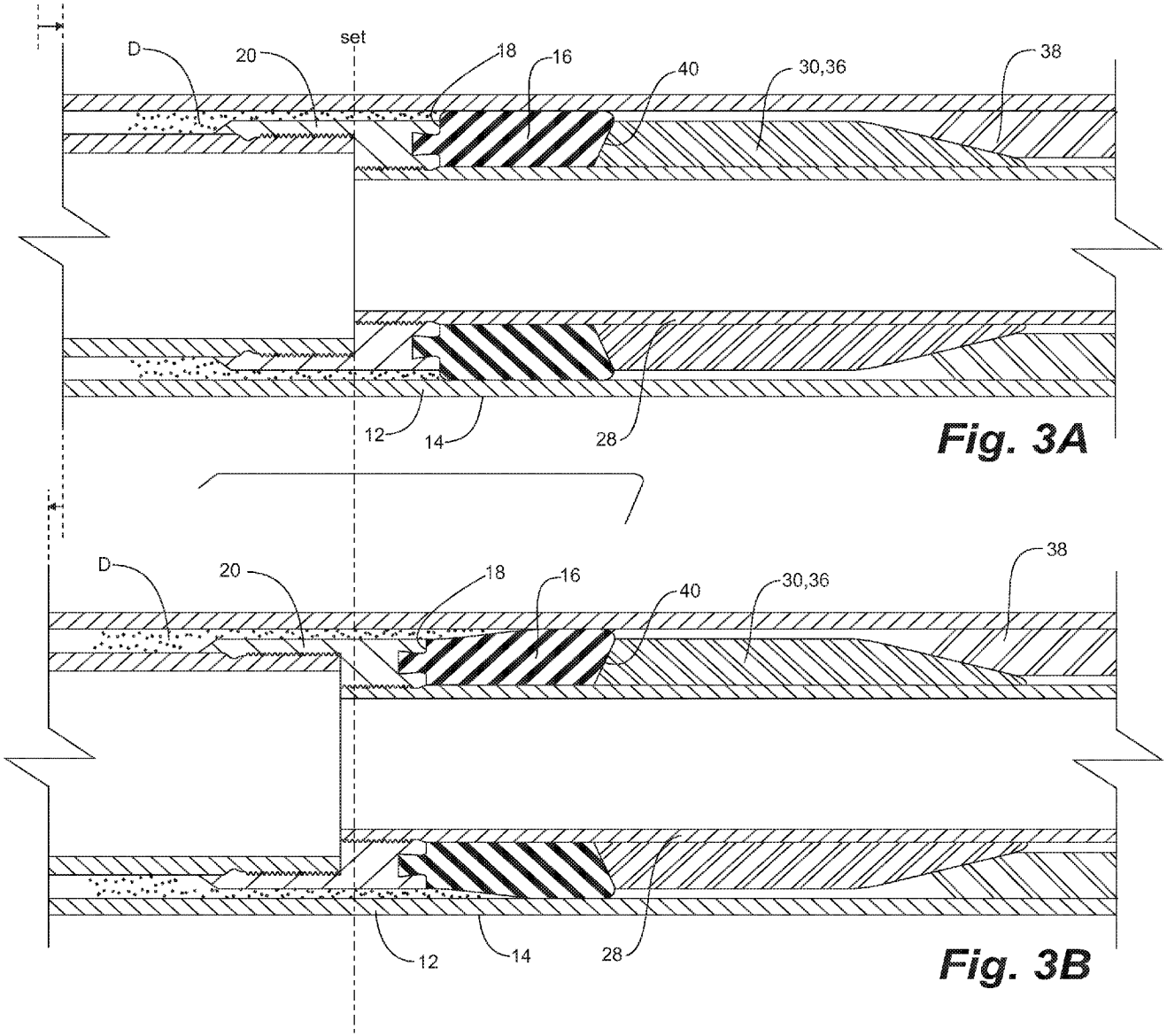
FIG. 3A is a cross-sectional view according to FIG. 2C illustrating debris collected in the annulus at an uphole face of the packer element which is radially energized and set against the casing.
FIG. 3B is a cross-sectional view according to FIGS. 2D and 3A illustrating movement of the debris as the packer element begins to thin and neck down.
Figure 3C:
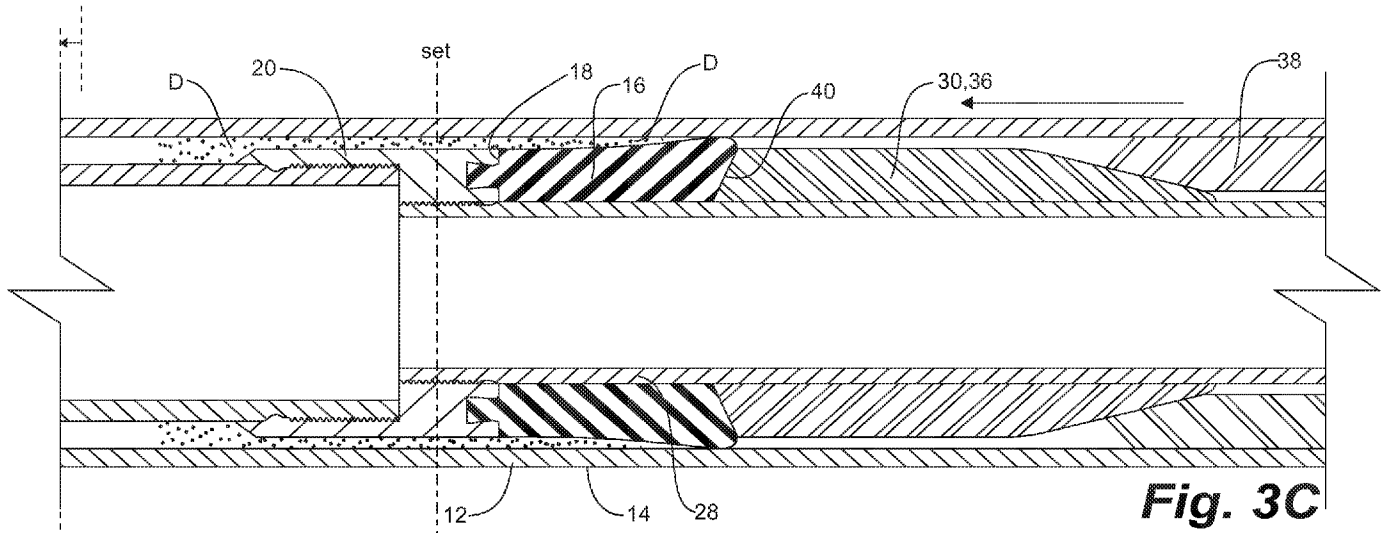
FIG. 3C is a cross-sectional view according to FIGS. 2E and 3A illustrating the debris as the packer element further thins and necks down.
Figure 3D:
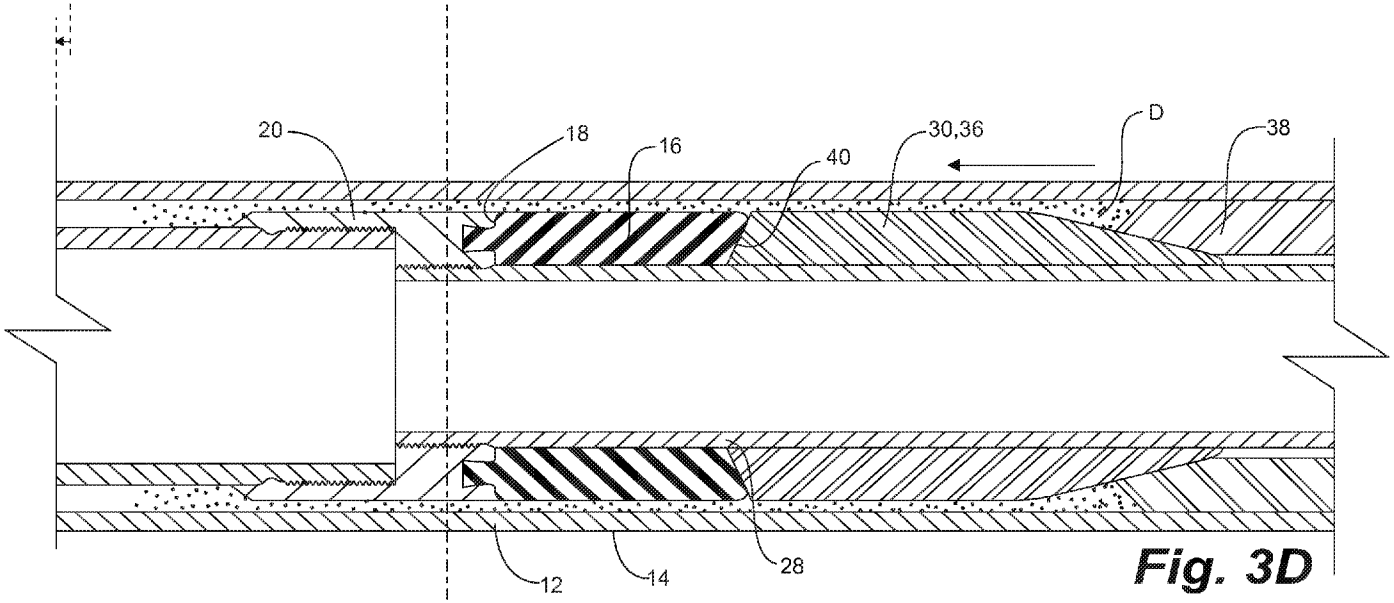
FIG. 3D is a cross-sectional view according to FIGS. 2F and 3A illustrating debris relief within the annular cross-sectional area as the packer element is released from the casing.
Figure 3E:
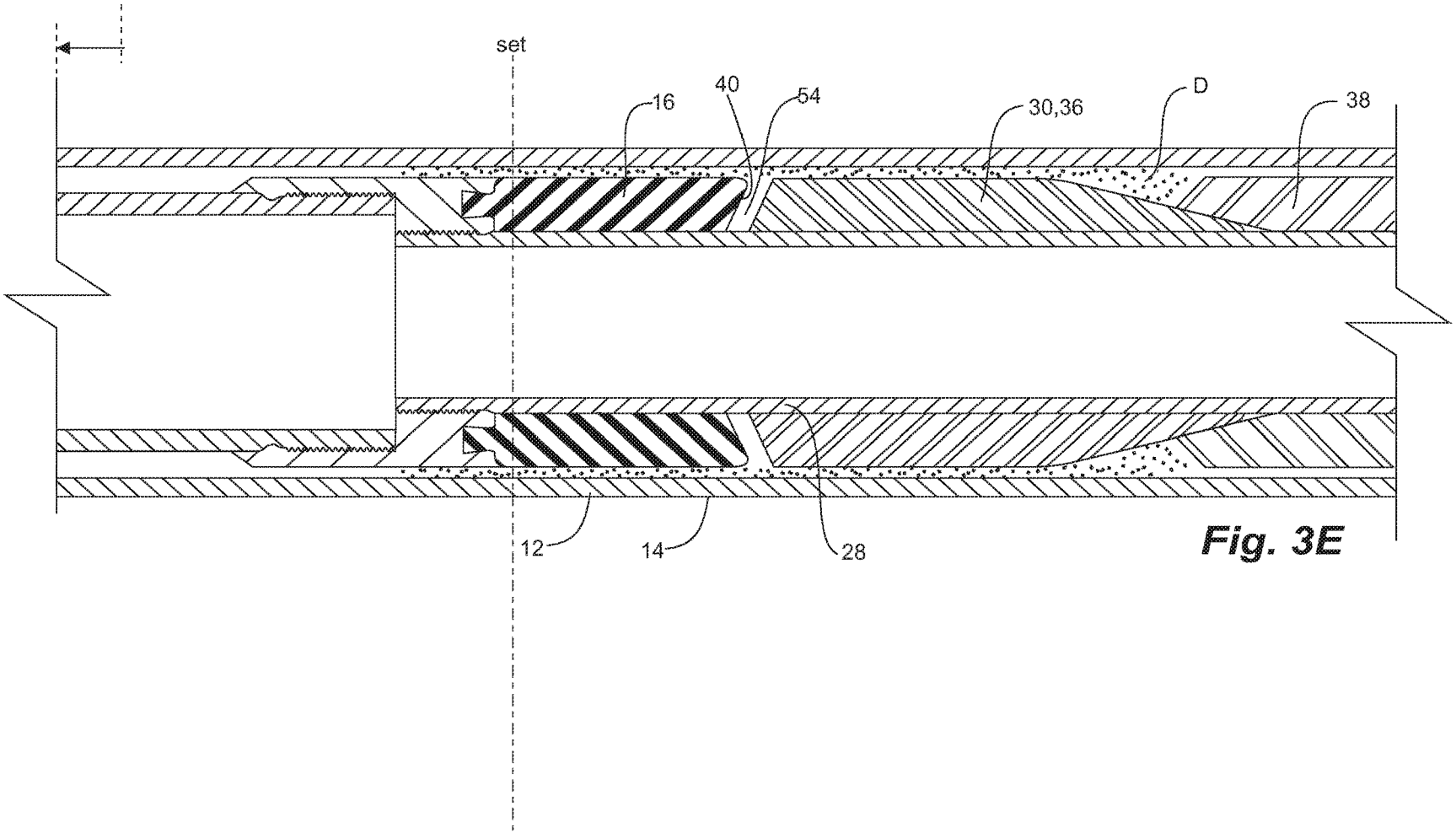
FIG. 3E is a cross-sectional view according to FIGS. 2G and 3D illustrating debris relief downhole through the annular cross-sectional area between the packer and the casing when the packer element is fully unset.

Instead, in embodiments disclosed herein, the uphole ring 20, connected to the mandrel 28 is also secured to the uphole pull end 18 of the annular sealing element 16, and therefore pulling on the ring 20 also pulls on the elastomeric, annular sealing element 16, causing the annular sealing element 16 to collapse or retract radially inwardly and release from sealing engagement with the tubular 12 (FIG. 2D). The uphole pull end 18 of the annular sealing element 16 is the first portion of a body of the annular sealing element 16 to be pulled in tension, and the first to stretch and to thin, or neck down, and release (FIG. 2D). Accordingly therefore, the first movement of the annular sealing element 16 uphole is also the point at which the annular sealing element 16 is being radially retracted from the casing, minimizing or eliminating any dragging and damage to the annular sealing element 16 associated therewith. As the annular sealing element 16 begins to retract radially inwardly from the casing 12, the cross-sectional area which forms is greater than that created when known pressure relief/equalization valves are opened. The annular sealing element 16 necks down from the uphole, pull end 18 (FIG. 2E), continuing to thin until the downhole end or trailing end 40 retracts radially from the casing 12 (FIG. 2F). Pressure above the annular sealing element 16, which is generally higher than below the annular sealing element 16, acting at the thinning annular sealing element 16, as tension is applied thereto, further assists in release of the annular sealing element 16 from the casing 12. Finally, the annular sealing element 16 is fully released from the casing 12 (FIG. 2G) forming the fluid passageway in the sealing annulus 32.

There are several unique advantages associated with pulling the uphole end 18 of the annular sealing element 16 uphole, not found in prior art BHA's. First, the uphole end 18 of the annular sealing element 16, also the most susceptible portion of the annular sealing element 16 with respect to plastic extrusion between the ring 20 and the casing 12, when energized, is the first to be radially retracted and released from the casing 12.

Having reference to FIGS. 3A-3E, additionally, any annular collection of debris D settled above the uphole end 18 of the annular sealing element 16, between the ring 20 and the casing 12, is disturbed, or more particularly bypassed as the annular sealing element 16 quickly assumes an at-rest or released diameter, about that of the diameter of the ring 20. Thus, the annular sealing element 16 is free to move through or beneath an annular-formed ring of debris D and not to drag through the settled debris or plow over the debris. As such, embodiments taught herein have enhanced debris relief compared to conventional tools, such as taught in CA 2,693,676.

Further, as stated above, there is no need to first equalize pressure above and below the annular sealing element 16 prior to movement of the BHA in the wellbore 14. The annular thinning of the annular sealing element 16, as the uphole end 18 is pulled, eventually permits the pressure above the annular sealing element 16, typically higher than below the annular sealing element 16, to assist in radially collapsing the annular sealing element 16 rather than acting to retain the packer in the energized state as in the prior art. Once the annular sealing element 16 has released from the casing 12, and collapsed to the at-rest diameter, fluid communication in the annular passageway formed in the sealing annulus 32, permits fluid to flow therethrough. Any debris D retained above the packer is washed downhole. While debris relief valves and seals are not required in embodiments taught herein, a debris relief valve could be incorporated for providing even larger cross-sectional area.

Further, as there is no need to equalize fluid pressure across the annular sealing element 16, just for the purpose of de-actuating the annular sealing element 16, one need not provide fluid bypass passages through the BHA 22. Fluid equalization eventually occurs through the fluid passageway formed in the sealing annulus 32 when the annular sealing element 16 is released from the casing 12. The fluid passageway formed in the sealing annulus 32 maximizes the cross-sectional area available for rapid fluid flow therethrough and equalization thereacross, such as when the BHA 22 is to be moved up and down the wellbore 14. As noted above, the cross-sectional area in the annulus 32 is typically greater than that achieved with conventional pressure equalization valves.

Further, as embodiments taught herein do not require flushing of debris or flow of fluids through the tool, the body of the BHA 22 can be used for other tool and assembly components, other than merely for flow therethrough. The BHA 22 can include instrumentation, or other actuation components heretofore too large to be accommodated in conventional BHA's with flow-through passages. Thus, as flow through the BHA 22 is not required, there is an ability to design tools which vary from conventional designs.

Having reference to FIG. 2E, in embodiments, when the annular sealing element 16 is pulled uphole and released from the casing 12, a gap 54 is formed between the trailing edge 40 of the annular sealing element 16 and the compression ring 30.

As stated above, the uphole end 18 of the annular sealing element 16 in this embodiment, is secured to the ring 20 for co-movement therewith as the ring 20 transitions from acting as the second compression ring when the annular sealing element 16 is compressed to seal to acting as a tension ring when the ring 20 is moved uphole with the mandrel 28. The form of securement can include, but is not limited to, elastomeric bonding such as vulcanization, mechanical bonding such as a tongue and dovetail arrangement, or both.

Figure 4:
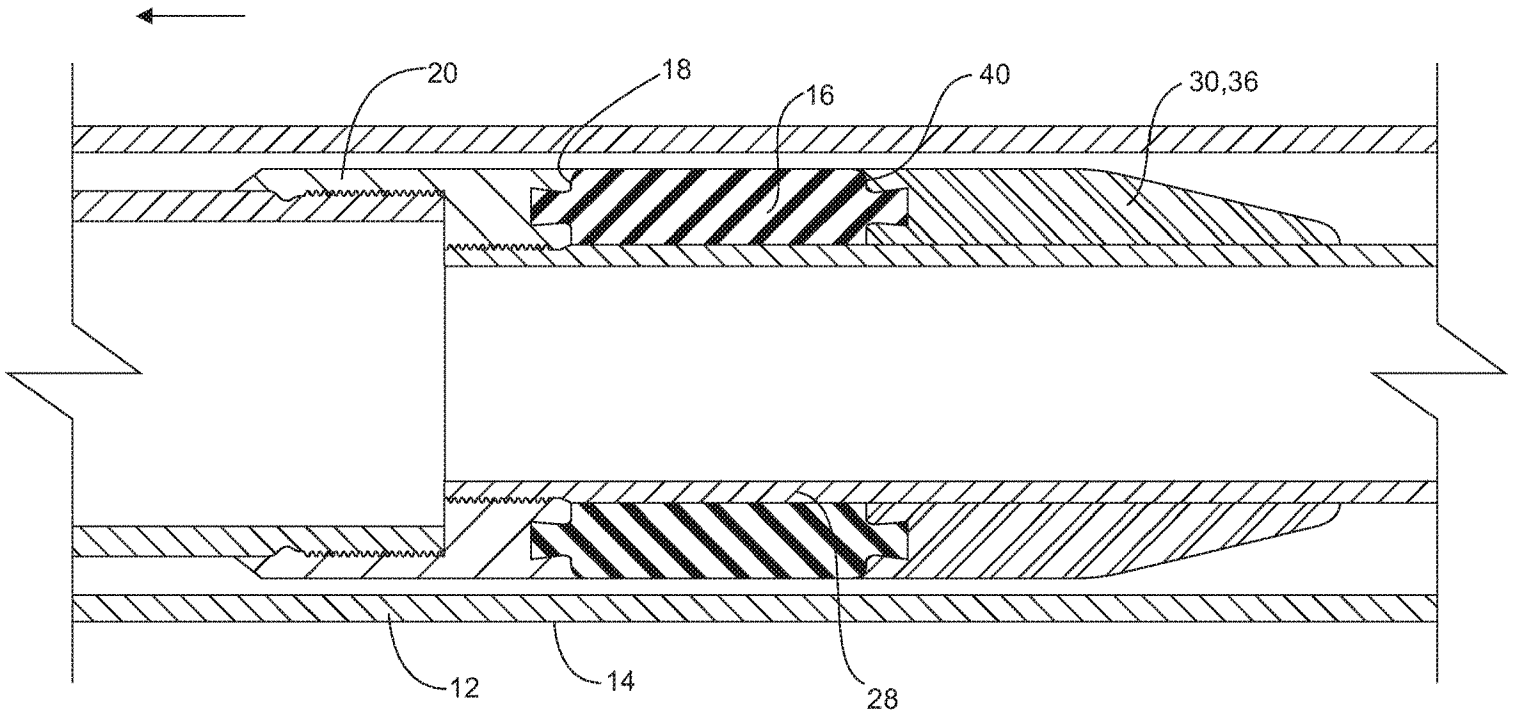
FIG. 4 is a cross-sectional view of an embodiment of a tension release packer as described herein, the packer element being attached to the mandrel at both the ring at an uphole end and the compression ring at a downhole end.

Having reference to FIG. 4, in embodiments, the ring 20 is secured to the mandrel 28 at both the uphole, pull end 18, such as described above, and also at the trailing, downhole end 40. The BHA 22 is located in the casing 12 and is held therein, such as by the releasable anchor 34, dogs or other means. As with the previously described embodiment, downhole movement of the uphole mandrel 28 moves the ring 20 downhole to act as a second compression ring, forcing the uphole end 18 of the annular sealing element 16 downhole. Without any obstacles to movement, the annular sealing element 16 is also driven downhole towards the BHA 22, held in position therebelow as the mandrel 28 telescopes within the housing 24. The annular sealing element 16 is compressed between the compression ring 30 and the ring 20 to seal against the casing 12, the anchor 34 or other means maintaining the positioning of the BHA 22 during compression of the annular sealing element 16.

As in the embodiments discussed above, to release the annular sealing element 16, the mandrel 28 is pulled to move uphole, pulling the uphole ring 18 and annular sealing element 16 secured thereto into tension. In this embodiment however, a length of uphole travel is limited to a length of the annular sealing element 16 when in the at-rest, uncompressed state. The length of uphole travel is however sufficient to cause the annular sealing element 16 to thin and neck down for releasing from the casing 12 without the need for a pressure equalization valve, as previously described. Unlike, the previous embodiment wherein the annular sealing element 16 is only attached at the uphole end, in this embodiment, the gap 54 is not formed between the annular sealing element 16 and the BHA 22 therebelow.

Further, in embodiments, the connection between the annular sealing element 16 and the mandrel 28, at one or both of the uphole and downhole ends 18, 40, is further reinforced to prevent damage to the annular sealing element 16 when placed in tension.

Having reference again to FIGS. 1 and 2A-2G, as in many prior art resettable packers, in embodiments, the compression ring 30 is provided by an uphole end 60 of the tubular cone 36, of the cone and slip anchor assembly 34, fit about the mandrel 28. Best seen in FIG. 2G, the uphole end 60 of the cone 36 is a generally radial face that cooperates with a similar radial face 62 of the downhole end 40 of the annular sealing element 16 to enable radial expansion of the annular sealing element 16. A downhole end 64 of the cone 36 is conical for releasably engaging and ramping under a circumferential array of the slips 38 supported by the housing 24. Thus, the downhole compression ring 30 or tubular cone 36 is moved downhole during packer actuation until the cone 36 engages the slips 38 for axial support, such as by the housing 24, permitting compression of the annular sealing element 16. In operation, the mandrel 28, uphole ring 20 and annular sealing element 16 move downhole. The annular sealing element 16 drives the cone 36 downhole and into engagement with the slips 38. The cone 36 drives the slips 38 outwardly, until the slips 38 anchor to the casing 12, arresting further downhole movement and supporting the cone 36 at the housing 24. Continued downhole movement of the mandrel 28 and the ring 20 causes compression of the annular sealing element 16 against the cone 36 for energizing the annular sealing element 16 into sealing engagement with the casing 12.

For de-actuation or release of the annular sealing element 16, the mandrel 28 and ring 20 are pulled uphole, pulling on the uphole end 18 of the annular sealing element 16 as described above.

Figure 5:
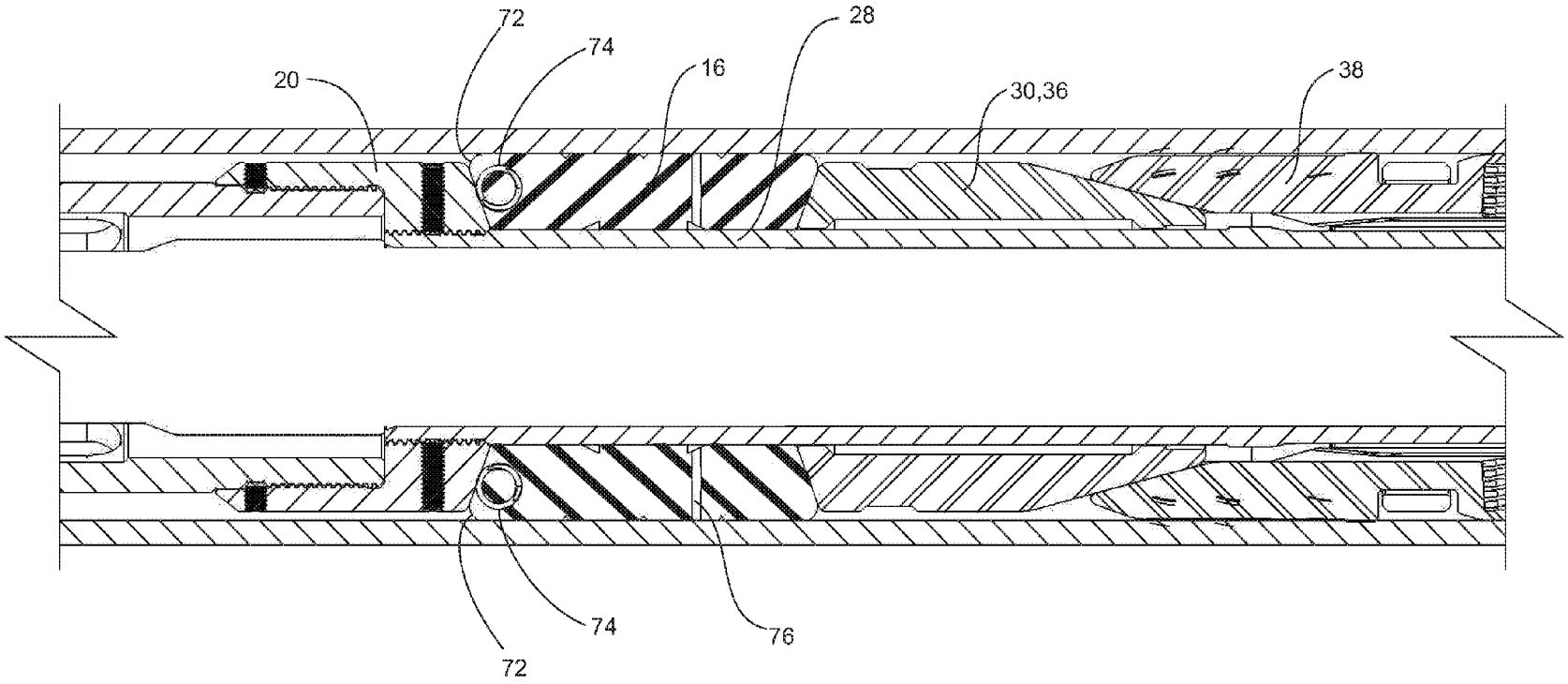
FIG. 5 is a cross-sectional view of according to FIG. 2C, the packer element having a circumferentially-extending spring embedded therein at the pull end.
Figure 6:
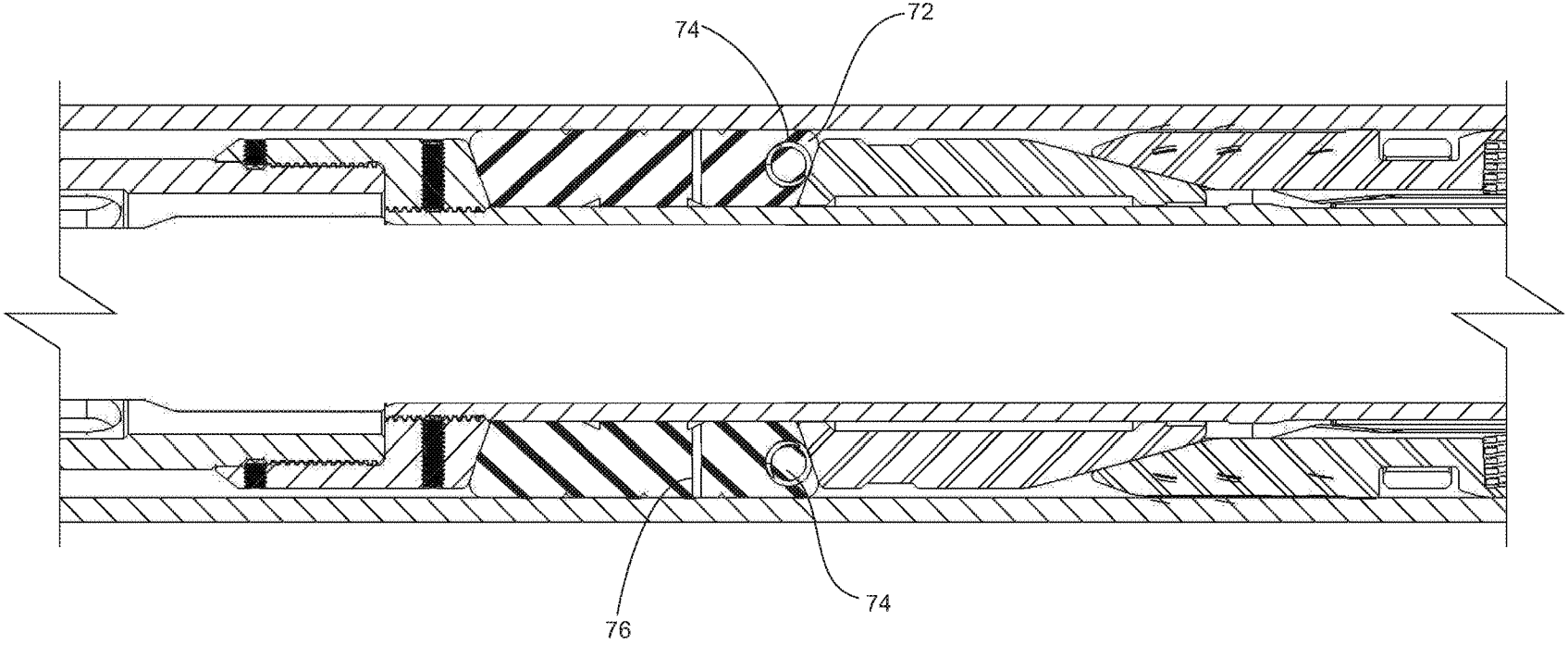
FIG. 6 is a cross-sectional view of according to FIG. 2C, the packer element having a circumferentially-extending spring embedded therein at a trailing end.
Figure 7:
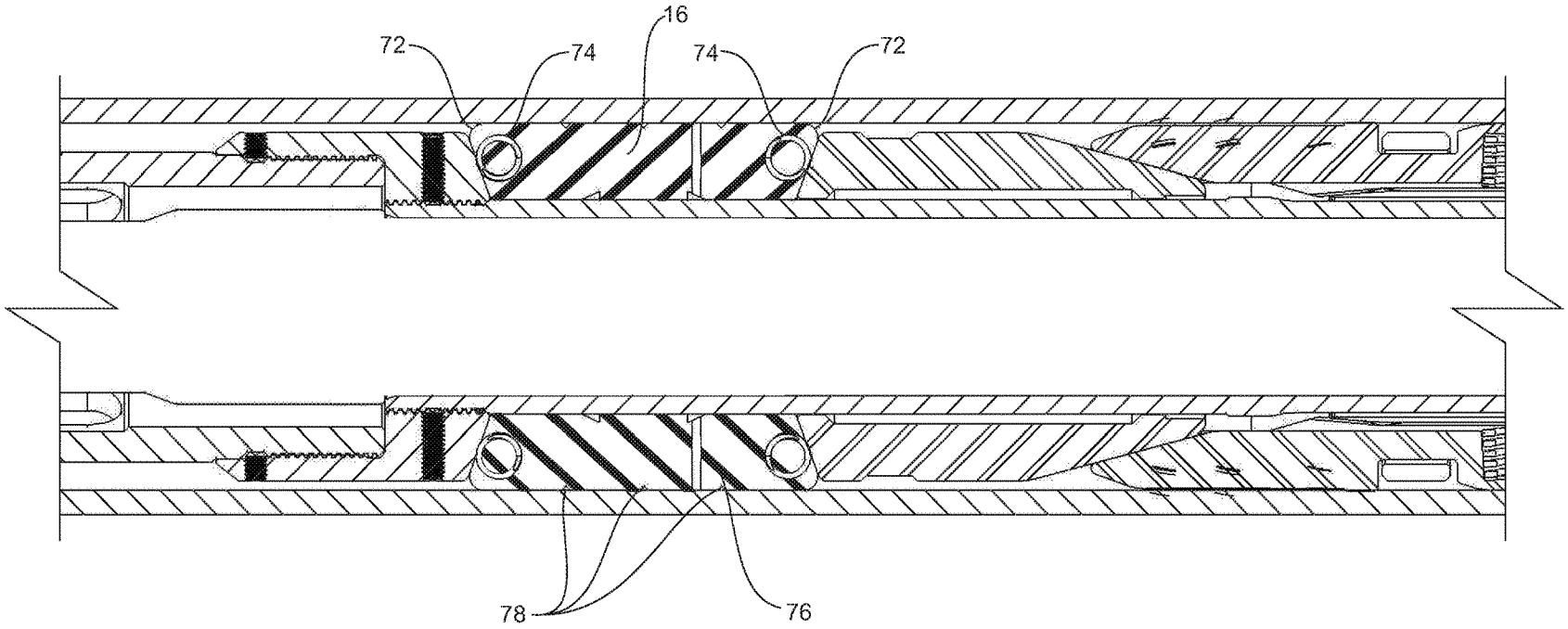
FIG. 7 is a cross-sectional view of according to FIG. 2C, the packer element having a circumferentially-extending spring embedded therein at both the pull end and the trailing end.

Optionally, as shown in FIGS. 5 to 7, for aiding radial release of the packer 10 and resistance to extrusion of the elastomeric annular sealing element 16, radially outward corners 72 of the uphole end 18 (FIG. 5), the downhole end 40 (FIG. 6) or both uphole and downhole ends 18,40 (FIG. 7) of the annular sealing element 16 are biased radially inwardly with circumferentially-extending springs 74 fit adjacent thereto. Dual, concentric rings can be formed within the elastomeric, annular sealing element 16.

Further, as shown in FIG. 7, the annular sealing element 16 has a hole or port 76 formed therethrough for minimizing fluid trapping in circumferential grooves 78 formed about a surface of the annular sealing element 16.

Figure 8:
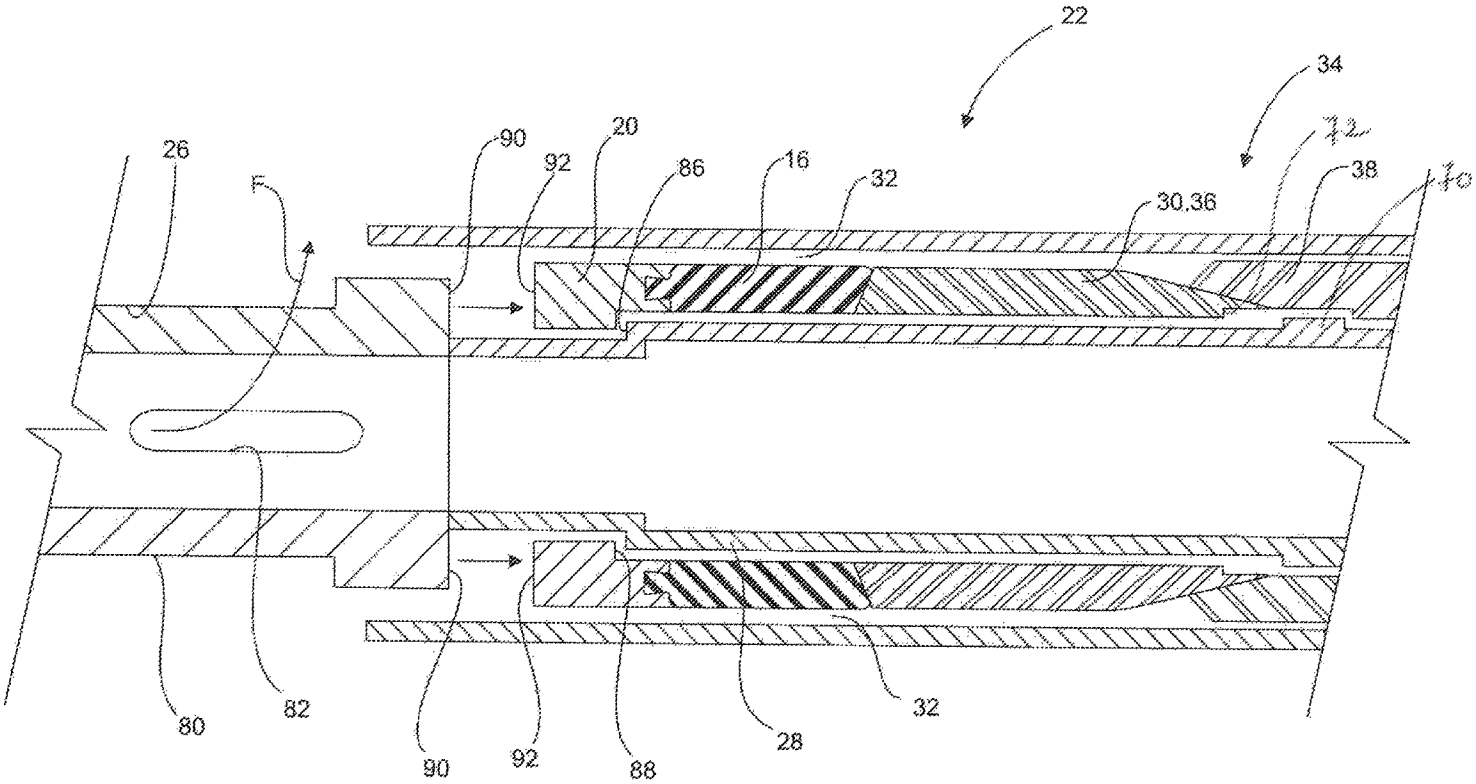
FIG. 8 is a cross-sectional view of a BHA comprising an embodiment of the packer taught herein, the BHA therebelow having flow paths eliminated therein for increasing available cross-sectional area within the BHA for additional apparatus to be located therein and further illustrating an annular upset on the mandrel for engaging the cone of a cone and slip anchor as well as an alternate embodiment having shoulders formed on the ring and the mandrel to operatively connect the ring to the mandrel for axially moving the ring and the mandrel toward and away from the housing for compressing and releasing the packer element.

As shown in FIG. 8, in embodiments, the mandrel 28 has an annular upset 70 formed thereon that approaches the downhole end 64 of the cone 36 as the mandrel 28 moves uphole. The annular upset 70 engages the downhole end 64 of the cone 36, such as at a release shoulder 72 and drives the cone 36 out from under the slips 38 for releasing the anchor 34. Thereafter, the BHA 22 is free to move axially in the casing 12.

As can be appreciated, means against which the annular sealing element 16 can be compressed, other than the cone 36, can be used for compression and expansion of the annular sealing element 16, without departing from the concepts taught herein.

Having reference again to FIGS. 1 and 8, where the BHA 22 is a completion tool, a tubular member 80, comprising one or more treatment ports 82, is provided in the BHA 22. The one or more treatment ports 82 are uphole of the tension release packer 10 and are fluidly connected to the bore 26 of the BHA 22 thereabove. The BHA 22 is run-in and located in the wellbore 14, such as using a casing collar locator CCL 84, for positioning the tension release packer 10 at or below a zone of interest in the formation. The annular sealing element 16 is energized as described herein through axial movement of the mandrel 28. When the packer 10 and BHA 22 are set in the wellbore, such as using the anchor 34, and the annular sealing element 16 is energized for sealing the annulus 32, formed between the BHA 22 and the casing 12, therebelow, fluid F is delivered through the treatment ports 82 in the tubular member 80. Fluid flows radially outwardly from the one or more treatment ports 82 and through openings in the casing 12, such as perforations, ports, sleeve ports or the like. In a fracturing operation, the fluid F is a fracturing fluid and is delivered at pressures sufficient to create fractures in the zone of interest in the formation. Thereafter, without tripping the BHA 22 out of the wellbore, the annular sealing element 16 is released from sealing engagement with the casing 12 by pulling on the mandrel 28 and the ring 20 to which the annular sealing element 16 is secured, as described above. Once released, the annular sealing element 16 thins and finally retracts away from the casing 12. The annular fluid passageway being formed in the sealing annulus 32 as a result permits pressure equalization across the annular sealing element 16 and further permits the flow of fluids and debris therethrough to below the annular sealing element 16. The annular sealing element 16 is then freely moveable within the casing 12 so that when the BHA 22 is moved to another zone of interest, damage to the annular sealing element 16 and swabbing therewith are minimized or eliminated.

Further, as shown in FIG. 8, in an embodiment where the ring 20 is not fixed to the mandrel 28 for axial movement therewith, a series of co-operating shoulders are used to axially pull and compress the annular sealing element 16 upon axial movement of the mandrel 28 relative to the housing 24. To apply tension, a first radially outwardly extending shoulder 86 formed on the mandrel 28 engages an opposing, radially inwardly extending second shoulder 88 formed on the ring 20. As the mandrel 28 is moved away from the housing 24, the ring 20 and uphole end 18 of the annular sealing element 16 secured thereto are lifted by the co-operating first and second shoulders 86,88.

To compress the annular sealing element 16, a third, radially extending shoulder 90, is operatively connected the mandrel 28, spaced from the first shoulder 86 for engaging a radial surface 92 of the ring 20 for applying a compressive force thereto for moving the ring 20 and annular sealing element 16 toward the housing 24 for compressing the element 16 therebetween. In embodiments, the third shoulder 90 is an opposing radial face formed on the tubular member 80.

The embodiments in which an exclusive property or privilege is claimed are defined as follows:

1. A method for completing a wellbore comprising:

running a completion tool, having a releasable packer therein, into the wellbore, the releasable packer having an annular elastomeric sealing element;

an anchor for anchoring the sealing element in the wellbore; and a mandrel and a housing, the mandrel being axially and telescopically moveable within the housing, the elastomeric sealing element being positioned circumferentially about the mandrel and connected at least at a pull end thereof;

locating the sealing element below a zone of interest in the wellbore;

axially compressing the elastomeric sealing element into sealing engagement with the wellbore and actuating the anchor by moving the mandrel axially toward the housing;

treating the zone of interest above the compressed elastomeric sealing element, creating a pressure differential across the sealing element, and thereafter;

applying axial tension to the pull end of the elastomeric sealing element for radially retracting at least the pull end thereof by moving the mandrel axially away from the housing for forming an annular passageway between the elastomeric sealing element and the wellbore, allowing pressure thereabove to equalize with pressure therebelow, for releasing the packer from sealing engagement with the wellbore.

2. The method of claim 1 wherein the mandrel is uphole of the housing and the pull end is an uphole pull end, releasing the packer comprising:

pulling the mandrel uphole for applying tension to the uphole pull end of the elastomeric sealing element for releasing the elastomeric sealing element from the wellbore.

3. The method of claim 2 wherein the elastomeric sealing element is connected to the mandrel by an uphole ring secured to the uphole pull end of the elastomeric sealing element, releasing the packer comprising:

pulling the mandrel and connected uphole ring uphole for releasing the elastomeric sealing element from the wellbore.

4. The method of claim 3 wherein the housing supports a compression ring, compressing the packer element comprising:

moving the mandrel, the connected uphole ring and the packer element toward the compression ring for compressing the elastomeric sealing element therebetween.

5. The method of claim 1, when the packer is released, further comprising:

flowing debris through the annular passageway from above the elastomeric sealing element to below the elastomeric sealing element.

6. The method of claim 1 wherein the pull end is an uphole pull end, further comprising:

biasing the uphole pull end of the elastomeric sealing element, a downhole end of the elastomeric sealing element, or both, radially inwardly.

7. The method of claim 1, wherein the anchor further comprises a set of slips supported by the housing and a cone operably connected to the mandrel between the annular packer element and the housing and wherein moving the mandrel axially toward the housing further comprises:

moving the cone towards the slips;

engaging the cone with the slips; and radially extending the slips into engagement with the wellbore.

8. The method of claim 7, wherein the elastomeric sealing element is connected to the mandrel by an uphole ring secured to an uphole pull end of the elastomeric sealing element.

9. The method of claim 3 wherein the uphole ring is connected to the mandrel by threads.

10. A method of equalizing pressure above and below a compressible, annular sealing element of a packer, the packer having a mandrel and a housing;

the mandrel being axially and telescopically moveable within the housing;

the annular sealing element being positioned circumferentially about the mandrel; and a pull end being secured thereto, set within a wellbore for sealing therebelow, comprising:

applying axial tension to the pull end of the annular sealing element for radially retracting at least the pull end by moving the mandrel axially away from the housing for forming an annular passageway between the annular sealing element and the wellbore, releasing the annular sealing element from sealing therein, wherein pressure above and below the elastomeric sealing element is equalized through the annular passageway.

11. The method of claim 10 further comprising:

flowing debris through the annular passageway from above the annular sealing element to below.

12. The method of claim 10 wherein the pull end is secured to the mandrel by threads.

13. A method for protecting a compressible, annular sealing element of a packer in a tool, the packer having a mandrel and a housing;

the mandrel being axially and telescopically moveable within the housing;

the annular sealing element being positioned circumferentially about the mandrel; and a pull end being secured thereto, set within a wellbore and having a pressure differential thereacross, prior to moving the tool within the wellbore, comprising:

applying axial tension to the pull end of the annular sealing element by moving the mandrel and pull end axially away from the housing for release from the wellbore for radially retracting at least the pull end for forming an annular passageway between the annular sealing element and the wellbore for equalizing pressure above and below the annular sealing element; and thereafter moving the tool in the wellbore.

14. The method of claim 13, wherein the pull end is an uphole pull end, further comprising:

biasing the uphole pull end of the annular sealing element, a downhole end of the annular sealing element, or both, radially inwardly.

15. The method of claim 13 wherein the pull end is secured to the mandrel by threads.

16. A pressure equalization tool for use in a wellbore comprising:

a tubular housing having a bore therethrough;

a mandrel fit to the bore of the housing and being telescopically and axially moveable therein;

an elastomeric, annular packer element fit concentrically about the mandrel and connected at a pull end thereto; and an anchor for anchoring the housing in the wellbore, wherein when the mandrel and annular packer element are moved axially toward the housing, the anchor is set and the annular packer element is compressed therebetween into sealing engagement with the wellbore for sealing an annulus between the mandrel and the wellbore; and wherein when the mandrel and annular packer element are pulled axially away from the housing, the annular packer element is pulled axially into tension for radially retracting at least the pull end for release from sealing engagement with the wellbore, forming a fluid passageway in the annulus for fluid communication past the annular packer element for equalizing pressure thereacross.

17. The pressure equalization tool of claim 16 wherein the pressure equalization tool is in a completion tool for completing the wellbore in a formation, further comprising:

a tubular member, the mandrel extending axially between the tubular member and the tubular housing;

one or more fluid ports in the tubular member;

wherein when the annular packer element is in sealing engagement with the wellbore for isolating the annulus therebelow, fluid is delivered from the fluid ports to a zone of interest above the annular packer element; and wherein when the annular packer element is released from sealing engagement with the wellbore, the tool is freely movable within the wellbore to another zone of interest or to surface.

18. The pressure equalization tool of claim 16 further comprising:

a ring operatively connected to the mandrel to which the pull end of the annular packer element is secured, wherein the ring, when moved axially by the mandrel away from the housing, applies tension to the annular packer element; and when moved axially by the mandrel toward the housing, compresses the annular packer element.

19. The pressure equalization tool of claim 18 wherein the ring is a steel ring, secured to the elastomeric annular packer element by elastomeric bonding, mechanical bonding or both.

20. The pressure equalization tool of claim 16 wherein the elastomeric annular packer element further comprises:

one or more circumferentially extending springs embedded therein adjacent an upper end, adjacent a lower end or both.

21. The pressure equalization tool of claim 16 further comprising:

a compression ring supported by the housing, the annular packer element being compressed thereagainst when the mandrel is moved axially toward the compression ring.

22. The pressure equalization tool of claim 21 wherein a trailing end of the packer element is secured to the compression ring.

23. The pressure equalization tool of claim 16 wherein the anchor comprises:

a set of slips supported by the housing; and a cone operatively connected to the mandrel between the annular packer element and the housing, the cone being axially moveable between the mandrel and the slips, for radially extending the slips into engagement with the wellbore, when the mandrel is moved axially toward the housing to compress the annular packer element.

24. The pressure equalization tool of claim 23 wherein the cone acts as a compression ring against which the annular packer element is compressed when the mandrel is moved axially toward the housing.

25. The pressure equalization tool of claim 23 further comprising:

an annular upset formed on the mandrel; and a release shoulder formed in the cone, wherein when the mandrel has moved axially away from the housing and released the annular packer element, the annular upset engages the release shoulder on the cone for moving the cone axially therewith and releasing the slips.

26. The pressure equalization tool of claim 18, further comprising:

a first shoulder extending radially outwardly from the mandrel; and a second, opposing shoulder extending radially inwardly from the ring, wherein when the mandrel is moved axially away from the housing to release the annular packer element, the first shoulder on the mandrel engages the second shoulder on the ring for applying tension to the annular packer element.

27. The pressure equalization tool of claim 26, further comprising a third shoulder spaced from the first shoulder, wherein when the mandrel is moved axially toward the housing, the third shoulder engages a radial surface of the ring for axially moving the ring and the annular packer element secured thereto, for compressing the annular packer element therebetween.

28. The pressure equalization tool of claim 16 wherein the annular packer element is compressed between the pull end of the annular packer element and the anchor.

29. The pressure equalization tool of claim 16 wherein the anchor is situate between the annular packer element and the housing.

30. The pressure equalization tool of claim 18 wherein the ring is operatively connected to the mandrel by threads.

31. The pressure equalization tool of claim 26 wherein the anchor comprises:

a set of slips supported by the housing; and a cone operatively connected to the mandrel between the annular packer element and the housing, the cone being axially moveable between the mandrel and the slips, for radially extending the slips into engagement with the wellbore, when the mandrel is moved axially toward the housing to compress the annular packer element.

32. The pressure equalization tool of claim 31 further comprising:

an annular upset formed on the mandrel; and a release shoulder formed in the cone, wherein when the mandrel has moved axially away from the housing and released the annular packer element, the annular upset engages the release shoulder on the cone for moving the cone axially therewith and releasing the slips.

* * * * *